United States Patent [19]

Hatzis

[11] 4,456,364

[45] Jun. 26, 1984

[54] MAGNETIC BRUSH HOPPER AGITATOR FOR ELECTROPHOTOCOPIER

[75] Inventor: Van Hatzis, Trumbull, Conn.

[73] Assignee: Pitney Bowes Inc., Stamford, Conn.

[21] Appl. No.: 386,507

[22] Filed: Jun. 9, 1982

[51] Int. Cl.[3] ..... G03G 15/08

[52] U.S. Cl. ..... 355/3 DD; 366/279; 366/320

[58] Field of Search ..... 355/3 R, 3 DD; 366/279, 366/320

[56] References Cited

U.S. PATENT DOCUMENTS 4,108,658 8/1978 Koeleman et al. ..... 355/3 DD X 4,274,362 6/1981 Beck et al. ..... 355/3 DD X

FOREIGN PATENT DOCUMENTS 552049 6/1932 Fed. Rep. of Germany ..... 366/320

*Primary Examiner*—Fred L. Braun

*Attorney, Agent, or Firm*—Lawrence E. Sklar; William D. Soltow, Jr.; Albert W. Scribner

[57] ABSTRACT

An improved agitating device in a developing apparatus for use in an electrophotocopying machine, wherein the developing apparatus includes a sump for holding a two-component developing material made up of a marking constituent and a magnetic carrier constituent, and a hopper for holding and dispensing the marking constituent to the sump. The improved agitating device agitates the marking constituent held in the hopper, and includes a straight section of wire rotatable through the marking constituent in the hopper, and a compression spring surrounding and hanging on the straight section of wire.

4 Claims, 3 Drawing Figures

MAGNETIC BRUSH HOPPER AGITATOR FOR ELECTROPHOTOCOPIER

BACKGROUND OF THE INVENTION

The instant invention relates to electrophotocopying machines and more particularly to an improvement in apparatus for agitating and dispensing the toner component in a two component developer material used in an electrophotocopying machine.

It is well known that in electrophotocopying machines employing a two component developer material, that toner (marking material) which is added to a toner hopper is regularly dispensed to the developer apparatus where it is mixed with a carrier material, such as iron fillings, prior to being attracted to a magnetic brush from which it may be further attracted to a photoconductive surface.

In order to provide for adequate agitation and dispensing of the toner from the hopper to the developer apparatus, various devices have been used which rotate through the toner in the hopper. However, none of the prior art devices has the capability of agitating the toner near the walls of the hopper to thereby prevent bridging of the toner to the walls of the hopper.

The instant invention accordingly overcomes the foregoing problem by providing a novel agitator for the toner which prevents bridging of the toner to the hopper walls, and facilitates the dispensing of the toner from the hopper to the developing apparatus therebelow.

SUMMARY OF THE INVENTION

The instant invention therefore provides an improvement in a developing apparatus for use in an electrophotocopying machine, the developing apparatus having a sump for holding a two-component developing material consisting of a marking constituent and a magnetic carrier constituent, and a hopper for holding and dispensing the marking constituent to the sump. The improvement is a device for agitating the marking constituent held in the hopper, and comprises a straight section of wire rotatable through the marking constituent in the hopper, and a compression spring surrounding and hanging on the straight section of wire.

DETAILED DESCRIPTION

Figure 1:
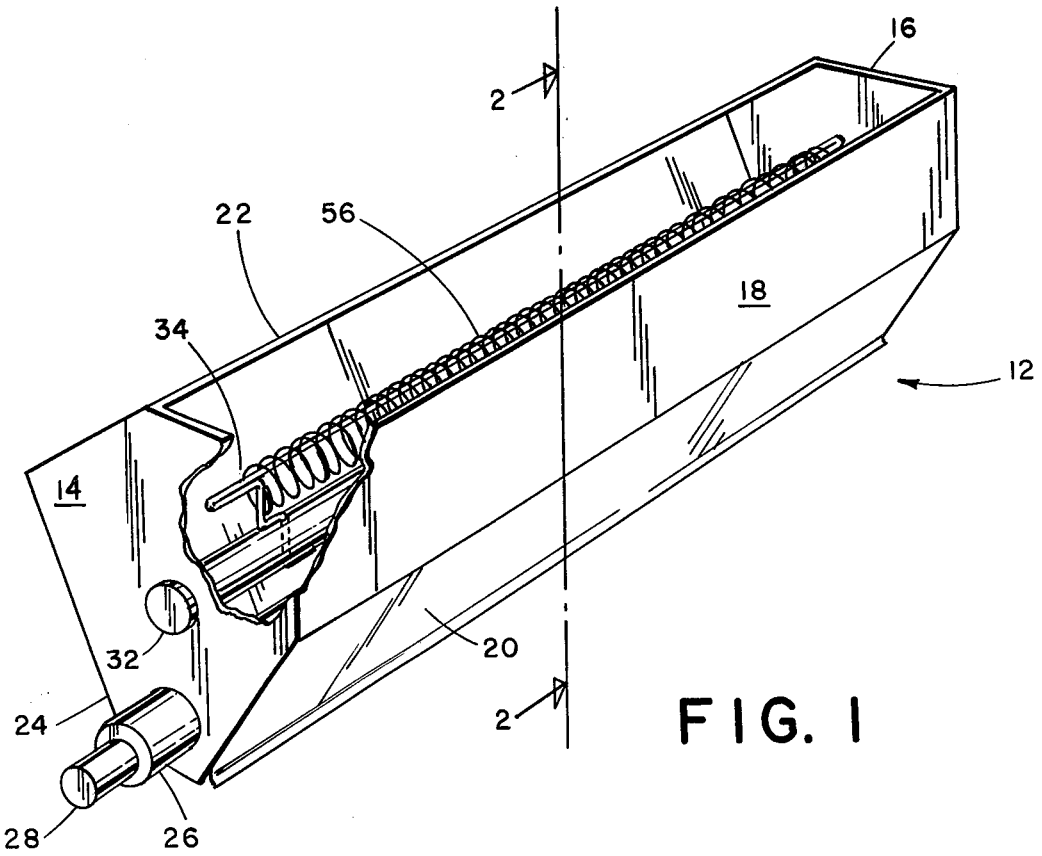
FIG. 1 is a perspective view of a toner hopper and a toner agitator therein according to the instant invention.

In describing the preferred embodiment of the instant invention, reference is made to the drawings wherein there is seen in FIG. 1 a hopper 12 having a pair of opposed sidewalls 14 and 16, an upper front wall section 18, a lower tapered front wall section 20, an upper rear wall section 22 and a lower, tapered rear wall section 24.

Figure 2:
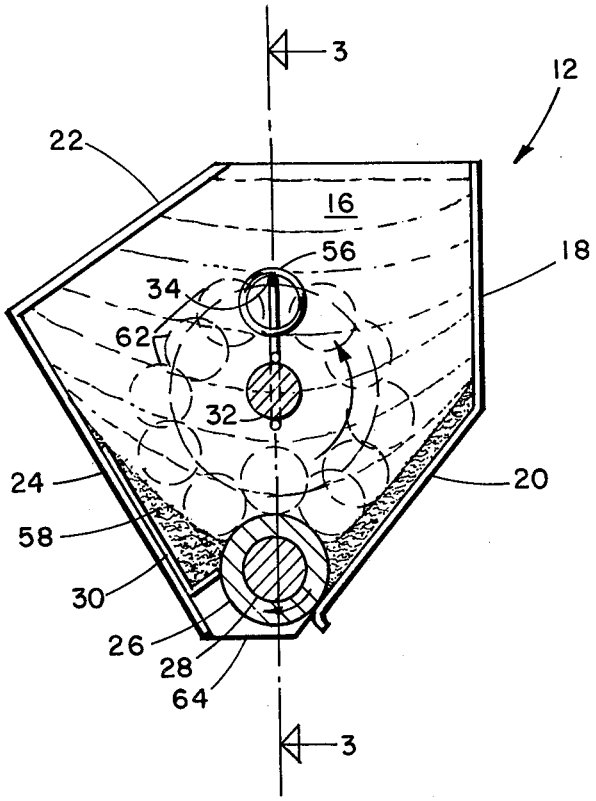
FIG. 2 is a sectional view taken on the vertical plane indicated by the line 2—2 in FIG. 1.
Figure 3:
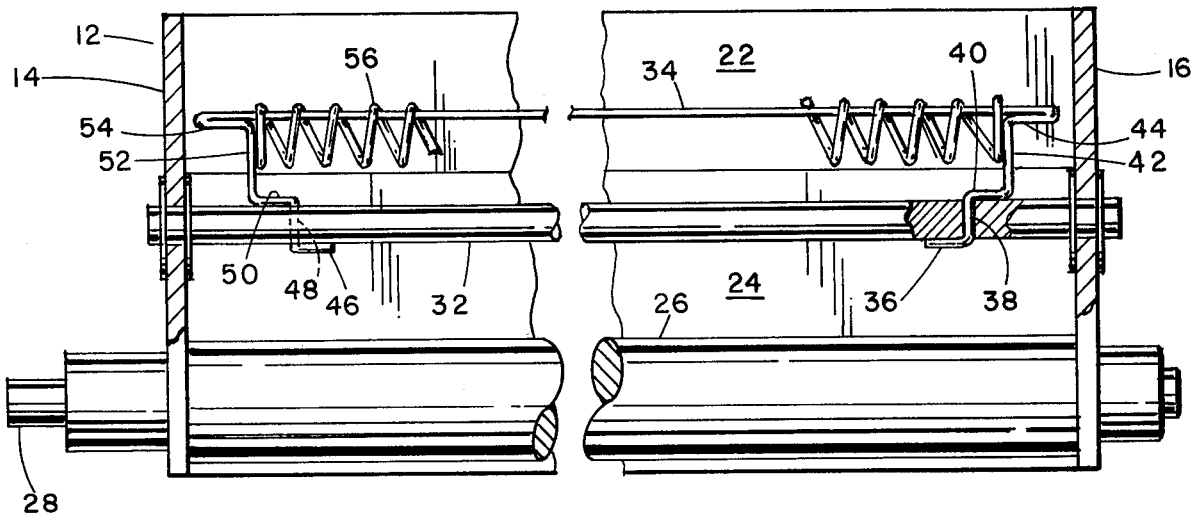
FIG. 3 is a sectional view taken on the vertical plane indicated by the line 3—3 in FIG. 2.

Situated at the bottom of the hopper 12 between the lower, tapered front wall section 20 and the lower, tapered rear wall section 24 is a dispensing roller 26 fixedly mounted on a shaft 28 which is driven in conventional manner by the driving elements (not shown) of the electrophotocopier with which the hopper 12 is associated. Mounted on the lower, tapered rear wall section 24 is an adjustable scraper blade 30 (see FIG. 2). Located above the dispensing roller 26 in the middle of the hopper 12 is a rotating shaft 32 supporting a straight section of wire 34 by means of a plurality of angled wire segments 36, 38, 40, 42 and 44 at one end and 46, 48, 50, 52, and 54 at the other end. Wrapped around and suspended from the straight section of wire 34 is a coiled section of wire or compression spring 56, which as seen in FIG. 2, floats about the straight section of wire 34. The actual position of the spring 56 with respect to the straight section of wire 34 will vary depending on the amount of toner or marking constituent 58 contained in the hopper 12.

The circular line 60 (see FIG. 2) shows the radial sweep of the straight section of wire 34, and how it does not get near the toner adjacent the front wall sections 18 and 20 and the rear wall sections 22 and 24. Again looking at FIG. 2, it can be seen that when the spring 56 is at the apex of its circular journey, it is virtually suspended from the straight section of wire 34. As the spring 56 rotates counterclockwise through the toner 58, it assumes the various positions 62 shown, and hangs less and less until it reaches the 6 o'clock position above the dispensing roller 26, at which point most of the compression spring 56 is located above the straight section of wire 34. As the straight section 34 continues its counterclockwise journey from the 6 o'clock position to the 12 o'clock position, the spring 56 begins to hang suspended from the straight section 34 more and more. It can be seen that the sweep of the compression spring 56 is such that is passes through the toner 58 adjacent the wall sections 18, 20, 22 and 24 of the hopper 12 to thereby minimize the bridging of the toner 58 to the hopper 12, and to thereby facilitate the dispensing of the toner 58 through the opening 62 at the bottom of the hopper 12 into the sump (not shown) of a developer apparatus located below the opening 64.

Excellent results have been obtained when a compression spring 56 comprising music wire 0.030 inch in diameter and having an outer diameter of 0.43 inch has been formed with 26 active coils and no load requirement. Experimental data has shown that when the hopper 12 becomes $\frac{2}{3}$ empty, that use of the compression spring 56 yields flow rates from the hopper 12 to the dispensing apparatus thereinbelow that are approximately double what the flow rates are without the compression spring 56. It is also true that the outer diameter of the compression spring 56 can be made larger in order to provide a greater sweep for the compression spring 56 so that it comes into closer contact with the front wall sections 18 and 20 and rear wall sections 22 and 24 of the hopper 12.

Numerous alterations of the structure herein disclosed will suggest themselves to those skilled in the art. However, it is to be understood that the description relates to a preferred embodiment of the invention which is for purposes of illustration only and is not to be construed as a limitation of the invention. All such modifications which do not depart from the spirit of the invention are intended to be included within the scope of the appended claims.

What is claimed is:

1. In a developing apparatus for use in an electrostatic copying machine, the developing apparatus having a sump for holding two-component developing material consisting of a marking constituent and a magnetic carrier constituent and a hopper for holding and dispensing the marking constituent to the sump, said hopper having an opening at the bottom thereof and a dispensing roller situated above said opening, an improved device for agitating the marking constituent held in said hopper, comprising:

a straight section of wire rotatable through said marking constituent in said hopper, said straight section of wire being rotatable about and parallel to a longitudinal center line of said hopper; and a compression spring surrounding and hanging on said straight section of wire, said compression spring being able to contact the hopper ⅓ of said dispensing roller when said compression spring rotates through the lower portion of its cycle and wherein said compression spring is supported entirely by said dispensing roller when said compression spring is in a 6 o'clock position above said dispensing roller, whereby said compression spring prevents bridging of the marking constituent to the walls of the hopper.

2. The improved device of claim 1, in which the compression spring is formed from music wire.

3. The improved device of claim 2, wherein the compression spring has an outer diameter such that said spring in the course of its revolution can almost touch the walls of said hopper.

4. The improved device of claim 2, wherein the diameter of the music wire is about 0.03 inch.

* * * * *